US005224824A

United States Patent [19]

Eng

[11] Patent Number: 5,224,824

[45] Date of Patent: * Jul. 6, 1993

[54] COMPRESSOR CASE CONSTRUCTION

[75] Inventor: Jesse Eng, Jupiter, Fla.

[73] Assignee: United Technologies Corporation, Hartford, Conn.

[ * ] Notice: The portion of the term of this patent subsequent to Jan. 19, 2010 has been disclaimed.

[21] Appl. No.: 896,746

[22] Filed: Jun. 9, 1992

Related U.S. Application Data

[63] Continuation of Ser. No. 581,219, Sep. 12, 1990, abandoned.

[51] Int. Cl.[5] ..... F04D 29/60

[52] U.S. Cl. ..... 415/209.2; 415/173.1; 415/209.3

[58] Field of Search ..... 415/115, 116, 209.1, 415/209.2, 209.3, 134–139, 173.1, 173.3

[56] References Cited

U.S. PATENT DOCUMENTS

| | | | |
|---|---|---|---|
| 2,510,606 | 6/1950 | Price | 415/139 |
| 2,848,156 | 8/1958 | Oppenheimer | 415/214.1 |
| 3,892,497 | 7/1975 | Gunderlock et al. | 415/134 |
| 4,762,462 | 8/1988 | Lardellier | 415/139 |
| 4,812,106 | 3/1989 | Purgavie | 415/139 |
| 5,118,253 | 6/1992 | Balkcum, III | 415/209.2 |
| 5,127,797 | 7/1992 | Carman | 415/209.2 |
| 5,131,811 | 7/1992 | Johnson | 415/209.2 |

*Primary Examiner*—John T. Kwon
*Attorney, Agent, or Firm*—Norman Friedland

[57] ABSTRACT

The last stages of a compressor section of a gas turbine engine that utilizes a drum rotor and segmented stator supported to an axially split outer case suspends the segmented stator case to a full hoop outer case so that the segmented stator displaces axially and thermally grows circumferentially while being constrained radially. A method of assembly and disassembly of the full hoop outer case is provided.

4 Claims, 7 Drawing Sheets

COMPRESSOR CASE CONSTRUCTION

The invention was made under a U.S. Government contract and the Government has rights herein.

This application is a continuation of Ser. No. 07/581,219 filed on Sep. 12, 1990, now abandoned.

CROSS REFERENCE

The subject matter of this application is related to the subject matter of the following commonly assigned patent applications: U.S application Ser. No. 581,223 entitled "Fastener For Multi-Stage Compressor"; U.S. application Ser. No. 581,224 entitled "Fastener Mounting For Multi-Stage Compressor"; U.S. application Ser. No. 581,231 entitled "Case Tying Means For A Gas Turbine Engine"; U.S. application Ser. No. 581,230 entitled "Compressor Bleed"; U.S. application Ser. No. 581,229 entitled "Segmented Stator Vane Seal"; U.S. application Ser. No. 581,228 entitled "Backbone Support Structure For Compressor"; U.S. application Ser. No. 581,227 entitled "Compressor Case Construction With Backbone"; U.S. application Ser. No. 581,240 entitled "Compressor Case Attachment Means"; U.S. application Ser. No. 581,220 entitled "Compressor Case With Controlled Thermal Environment"; all of the above filed on even date herewith.

TECHNICAL FIELD

This invention relates to the compressor section of gas turbine engines and more particularly to a full hoop case and the stator support means.

BACKGROUND ART

As is well known, the compressor case of a gas turbine engine powering aircraft is subjected to severe pressure and temperature loadings throughout the engine operating envelope and care must be taken to assure that the components remain concentric maintaining relatively close running clearances so as to avoid inadvertent rubs. Inasmuch as the engine case is thin relative to the rotor and stator components in the compressor section, it responds more rapidly to temperature changes than do other components. This is particularly true during periods of transient engine performance. Typical of these transients are throttle chops, throttle bursts, and the like. Obviously it is customary to provide sufficient clearances during these transients to assure that the rotating parts do not interfere with the stationary parts.

The problem becomes even more aggravated when the engine case is fabricated in two halves (split case) which is necessitated for certain maintenance and construction reasons. Typically, the halves are joined at flanges by a series of bolts and the flanges compared to the remaining portion of the circumference of the case is relatively thick and hence does not respond to thermal and pressure changes as quickly as the thinner portion of the case. The consequence of this type of construction is that the case has a tendency to grow eccentrically or out of round.

In order to attain adequate roundness and concentricity to achieve desired clearance between the rotating and non-rotating parts, I have found that the segmented stator vanes tied to a full hoop case for the highest stages of a multiple stage compressor of a gas turbine engine enhanced the structural integrity sufficiently to meet the engine's requirements. Since the stator components, i.e., stator vanes and outer air seals, are segmented the problem was to assure that the compressor maintained its surge margin notwithstanding the fact that the outer case would undergo large deflection at acceleration and deceleration modes of operation. The cavity that exists between the outer case and the inner case formed by the segmented stator components, being subjected to pressures occasioned by the flow of engine air through the various leakage paths, presented a unique problem. In the event of a surge, which is a non-designed condition, the pressure in the gas path would be reduced significantly. Because the air in the cavity is captured and cannot be immediately relieved, it would create an enormous pressure difference across the stator components, cause them to distort, with a consequential rubbing of the compressor blades, and a possible breakage.

In order to withstand this pressure loading and yet achieve the roundness and clearance control of the stationary and rotating components it was necessary to incorporate a mechanism that would tie the outer case to the segmented stator components. While it became important to assure that this rubbing did not occur, particularly where severe rubbing could permanently damage the blades and/or rotor/stator during surge, the mechanism that is utilized must be capable of withstanding this enormous load, yet be insensitive to fatigue.

Moreover, in order to achieve roundness and maintain close tolerance between the tips of the blades and outer air seal it is abundantly important that the components subjected to high thermal and load differentials do not allow the outer and inner cases to grow eccentrically. To this end the aft end of the stator is supported by a bulkhead or a back bone that is formed from a relatively straight shaped annular support that is attached to the inner segmented case and the outer case. The bulkhead or backbone is attached in such a way that the inner case floats axially and circumferentially while being restrained radially. While this arrangement enhances the control of the clearances between the tips of the blades and outer air seal, it is only a portion of the support necessary for the stator.

While the design of the aft end of the engine case support structure as described above provides axial and circumferential freedom, it is also necessary to provide other means to allow axial and circumferential movement at the forward end of the stator structure that is supported by the full hoop engine case. In accordance with this invention, I have provided a "tongue and groove" arrangement that provides the radial restraint and allows each segment to grow thermally in the axial and circumferential direction.

This configuration also facilitates the assembly and disassembly of the full hoop over a segmented stator and drum rotor. As mentioned above, the stator vanes are segmented and includes a portion of the three rows of vanes in a single casting. When assembled, the segments are mounted end-to-end to form an inner ring-like case and three circumferential rows of spaced vanes.

STATEMENT OF THE INVENTION

An object of this invention is to provide an improved structural support for a portion of the stators of the high pressure compressor of a gas turbine engine.

A feature of this invention is to provide for a compressor drum rotor means for suspending and supporting the stator to the full hoop compressor case that permits axial displacement and circumferential thermal growth of the stator segment while providing radial support and positioning.

The foregoing and other features and advantages of the present invention will become more apparent from the following description and accompanying drawings.

BEST MODE FOR CARRYING OUT THE INVENTION

Figure 1:
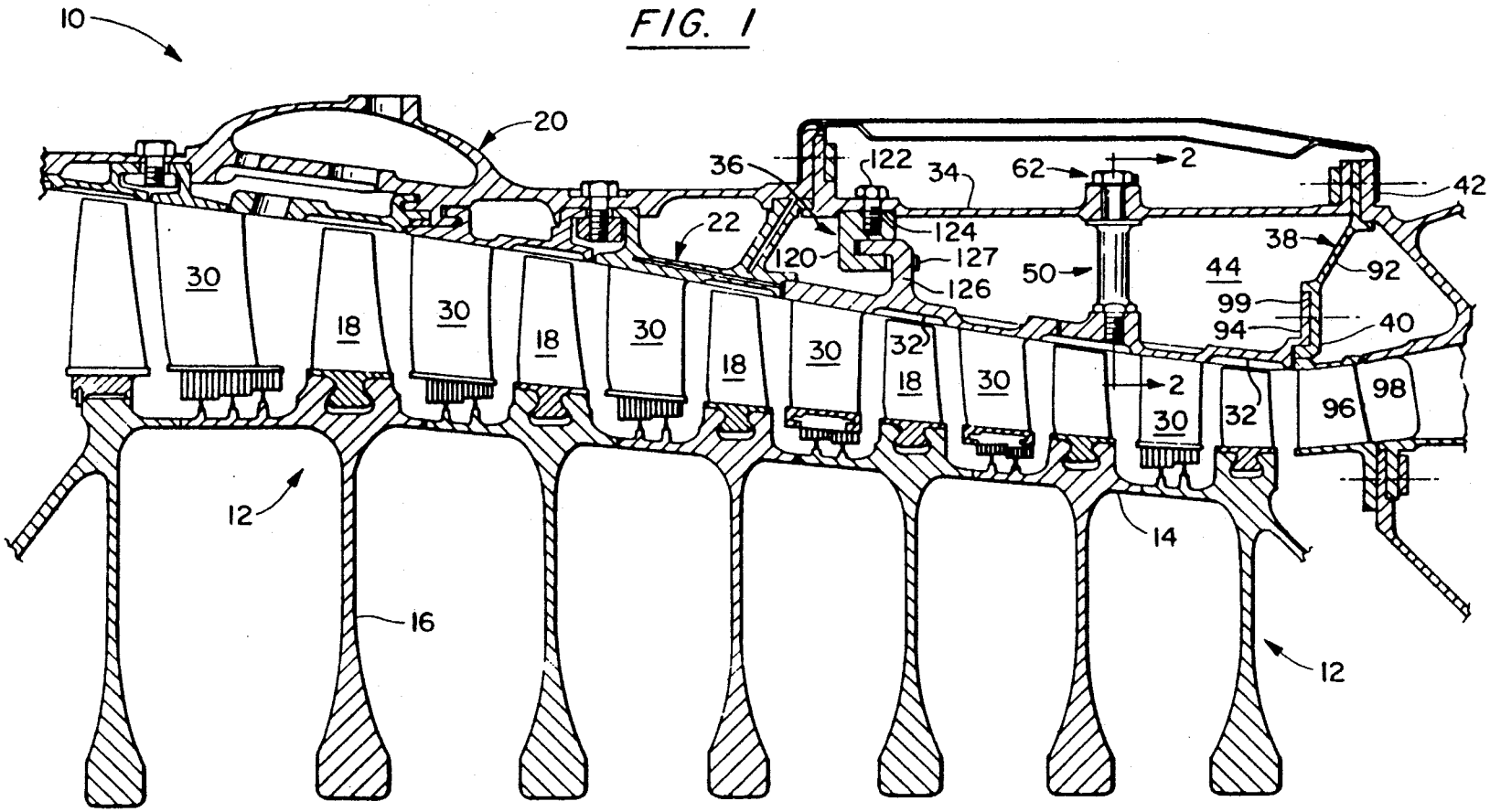
FIG. 1 is a partial view partly in section and partly in elevation of a multi-stage axial flow compressor for a gas turbine engine.
Figure 2:
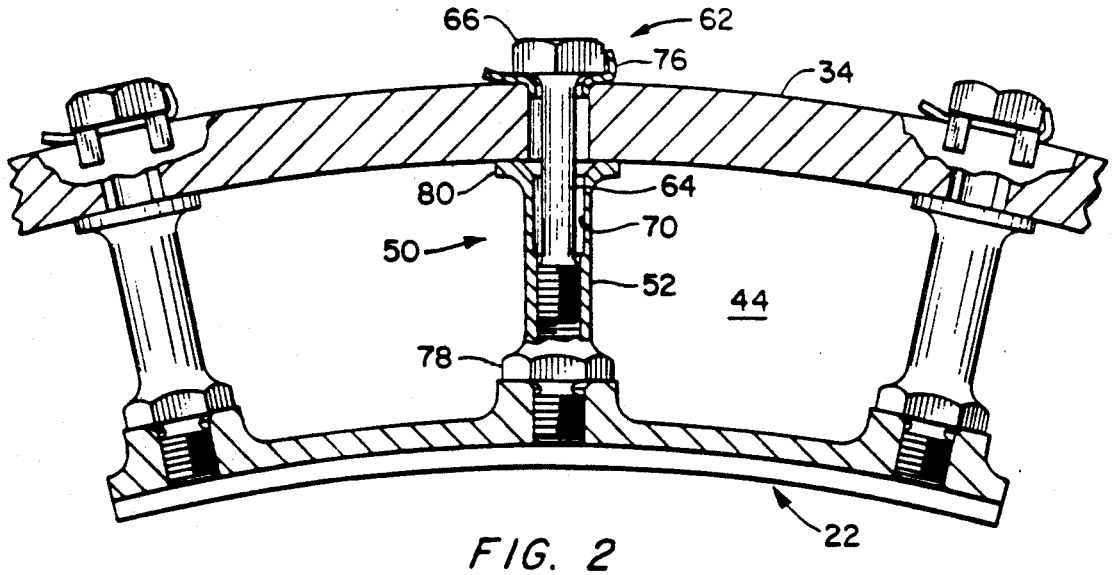
FIG. 2 is a partial sectional view partly in schematic taken along lines 2—2 of FIG. 1 showing one of several segments of the components making up the inner case.
Figure 3:
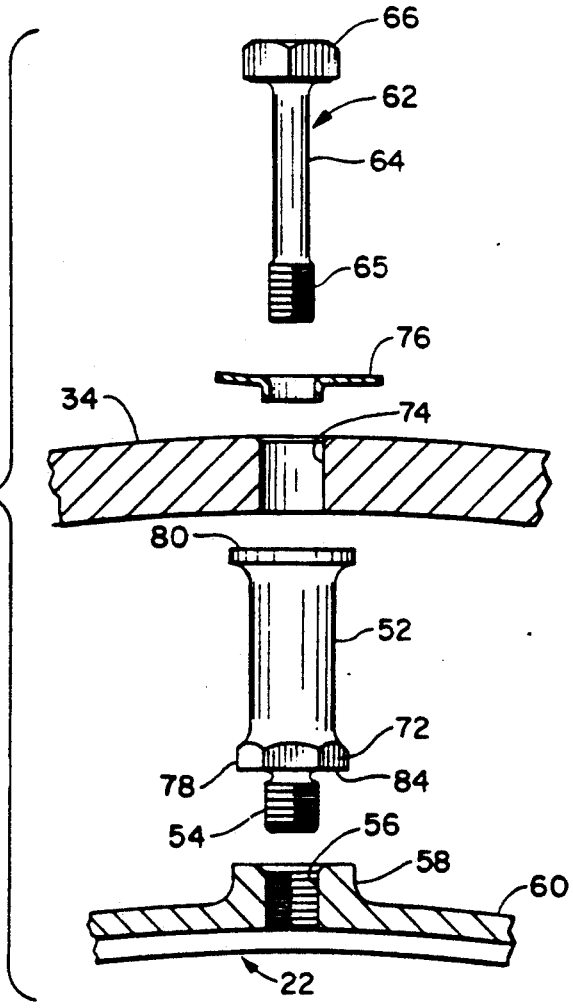
FIG. 3 is an exploded view in perspective showing the details of the spool/bolt.
Figure 4:
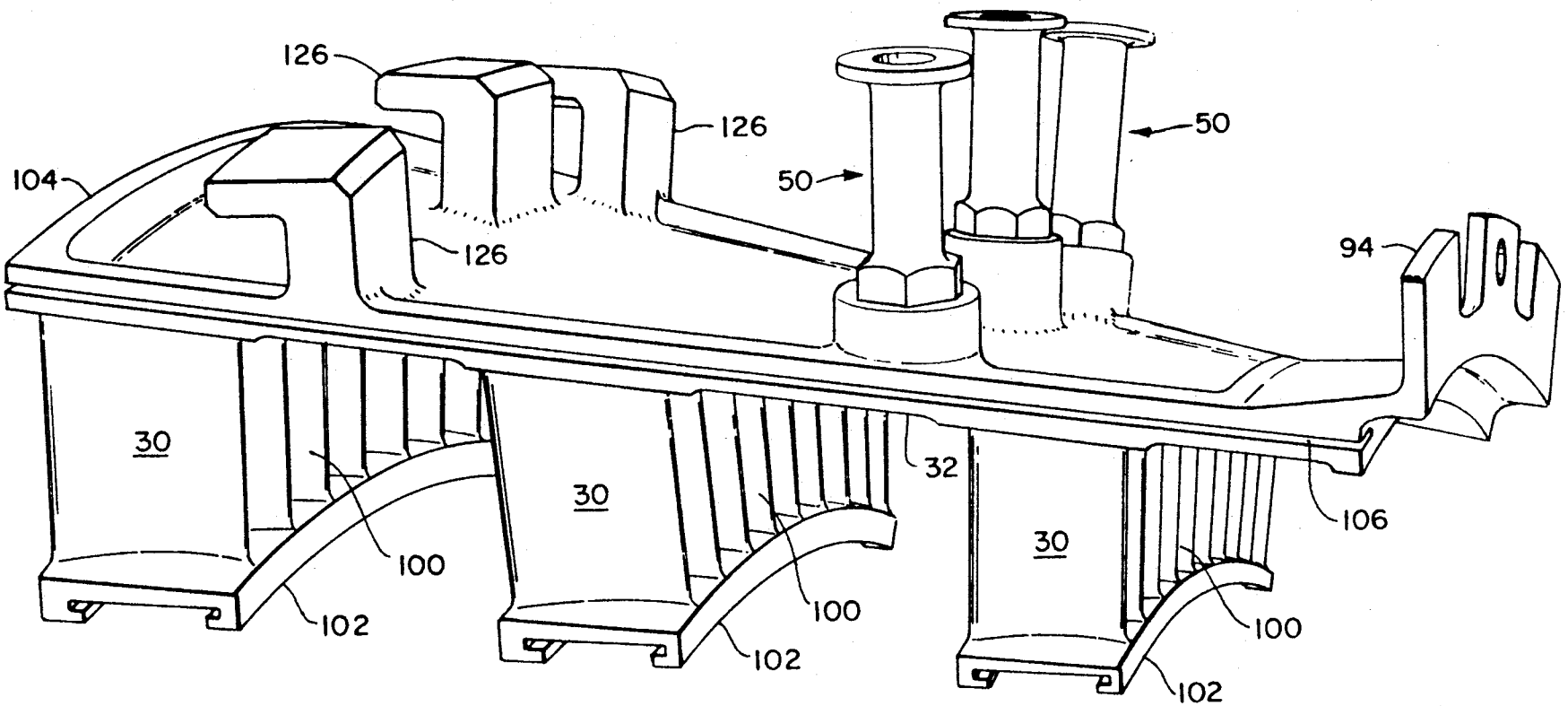
FIG. 4 is a perspective view showing the details of a segment of the stator vane.

To best understand this invention reference is made to FIGS. 2, 3 and 4 showing part of a multi-stage compressor for a gas turbine engine of the type for powering aircraft. For more details of a gas turbine engine the F100 family of engines manufactured by Pratt & Whitney, a division of United Technologies Corporation, the assignee of this patent application, is incorporated herein by reference. Suffice it to say that in the preferred embodiment the engine on which this invention is being utilized is a fan-jet axial flow compressor multi-spool type. As noted in FIG. 1 the compressor section generally indicated by reference numeral 10 is comprised of a plurality of compressor rotors 12 retained in drum rotor 14, where each rotor includes a disk 16 supporting a plurality of circumferentially spaced compressor blades 18. The rotors 12 are suitably supported in an outer engine case 20 and an inner case 22.

In this configuration a portion of the outer case 20 is fabricated in two axial circumferential halves and the other portion is fabricated in a full hoop generally cylindrically shaped case. In FIG. 1 the first four lower pressure stages as viewed from the left hand side are housed in the split case and the last three stages are housed in the full case.

Inasmuch as this invention pertains to the aft section (full case) of the compressor, for the sake of simplicity and convenience only the portion of the compressor dealing with the full case will be discussed hereinbelow. The inner case 22 which comprises the stator vanes 30 and outer air seal 32 are supported in the full case 34 via the dog-jaw hook connection 36 and the bulkhead 38 which carries suitable attaching flanges 40 and 42.

As was mentioned above the problem associated with this construction is that the cavity 44 between the inner case 22 and outer case 34 is ultimately pressurized by the fluid leaking therein from the engine flow path. The engine flow path is defined by the annular passageway bounded by the inner surface of the inner case 22 and outer surface of drum rotor 14. This pressure can reach levels of 500–600 pounds per square inch (PSI). Should a surge situation occur the pressure level in the gas path can reduce, instantaneously to a value much lower than the 500–600 PSI and since the pressure in cavity 44 is trapped and can only be reduced gradually, an enormous pressure differential exists across inner case 22.

The spool/bolt arrangement generally illustrated by reference numeral 50 ties the inner case 22 to outer case 34 in such a manner as to enhance fatigue life and provide sufficient strength to withstand the compressor surge problems. Spool/bolt 50 comprises a spool member 52 having a reduced diameter threaded portion 54 at its lower extremity adapted to be threaded onto the complementary internal threads 56 formed in boss 58 extending radially from the outer surface 60 of inner case 22.

The bolt 62 comprises a relatively long shank 64 carrying threads 65 at the lower extremity and a significantly large head 66. Head 66 may be hexagonally shaped and is thicker and has a longer diameter than otherwise would be designed for this particular sized shank. These unusual dimensions of the head serve to reduce the stress concentration and increase fatigue life of the head to shank fillet adjacent the head.

The bolt 62 fits into bore 70 centrally formed in spool 52 that terminates just short of the remote end of the entrance to the bore. The inner diameter of bore 70 is threaded to accommodate the threaded portion of bolt 62. The spool 52 carries a tool receiving portion 72 for threadably securing the spool to inner case 22.

In the assembled condition, the spool 52 is threaded to inner case 22 and the bolt 62 passing through opening 74 in the outer case 34 is threaded to the inner threads of the spool 72, until the head bears against the outer surface of outer case 34 or a suitable washer. Tab washer 76 may be employed to prevent the bolt from inadvertently retracting.

After the spool is torqued sufficiently to urge end face 78 to bear against inner case 22, the bolt 62 is sufficiently torqued so that the flange-like portion 80 of the spool bears against the inner surface of outer case 34. The amount of torque will depend on the particular application but it should be sufficient to keep spool 52 in compression throughout the operating range of the engine.

As is apparent from the foregoing, the spool serves as a compressed flange-like member thus reducing both bolt fatigue and surge stresses. This configuration resists fatigue loads occasioned by thermal axial deflection differences between outer case 34 and the segmented inner case 22.

The thread sizes of threads 65 of bolt 62 and threads 54 of spool 52 are different (the threads 54 are specifically designed to be larger). Because the diameter of the spool threads 54 are larger it has a higher disassembly breakaway torque than bolt 62. Consequently, the bolt will, by design, loosen first.

The bulkhead 38 or backbone is a load carry member and is generally annularly shaped forming a relatively straight piece but having a radially extending lower portion 40, an angularly extending middle portion 92 and another radially extending upper portion 42. As mentioned earlier the extremities, i.e. the lower and upper portions 40 and 42 serve basically as flanges and are adapted to be bolted to the inner and upper cases 22 and 20, respectively. The forward face of the lower portion 40 is recessed to accept the radially extending flange 94 integrally formed on the rear end of the inner segmented case 22, forming a somewhat tongue-in-groove arrangement. The inner diameter 96 of bulkhead 38 is dimensioned so that it snugly fits onto the upper surface of the next adjacent stator vane assembly 98 which serves to reduce scrubbing of the case tied assembly, just described.

As described above, the stator vane 30 are cast into unitary segments that when mounted end-to-end in the circumferential direction forms three (3) rows of vanes. The stator vane comprises circumferentially spaced airfoil sections 100 and an inner shroud 102 and an outer shroud 104, the outer shroud defining the inner case. As viewed from the perspective drawing of FIG. 4, the three rows of vanes are unitary with the outer shroud 104 and each segment abuts the adjacent segment. Groove 106 is provided to receive a suitable seal that serves to memorize leakage between adjacent segments.

A plurality of circumferentially spaced removable support segments 120 are bolted by bolts 122 to fit into the recess or groove 124 formed on the inner diameter of the full hoop case 34. A complementary number of hooks 126 (see FIG. 4) are likewise spaced circumferentially around the stator vane segments and extend radially to form a radial "tongue and groove" fit. As is apparent from the foregoing, the "tongue and groove" or dog-bone serve to tie the stator vane or inner case to the outer case and restrain the radial movement of the case.

Figure 5B:
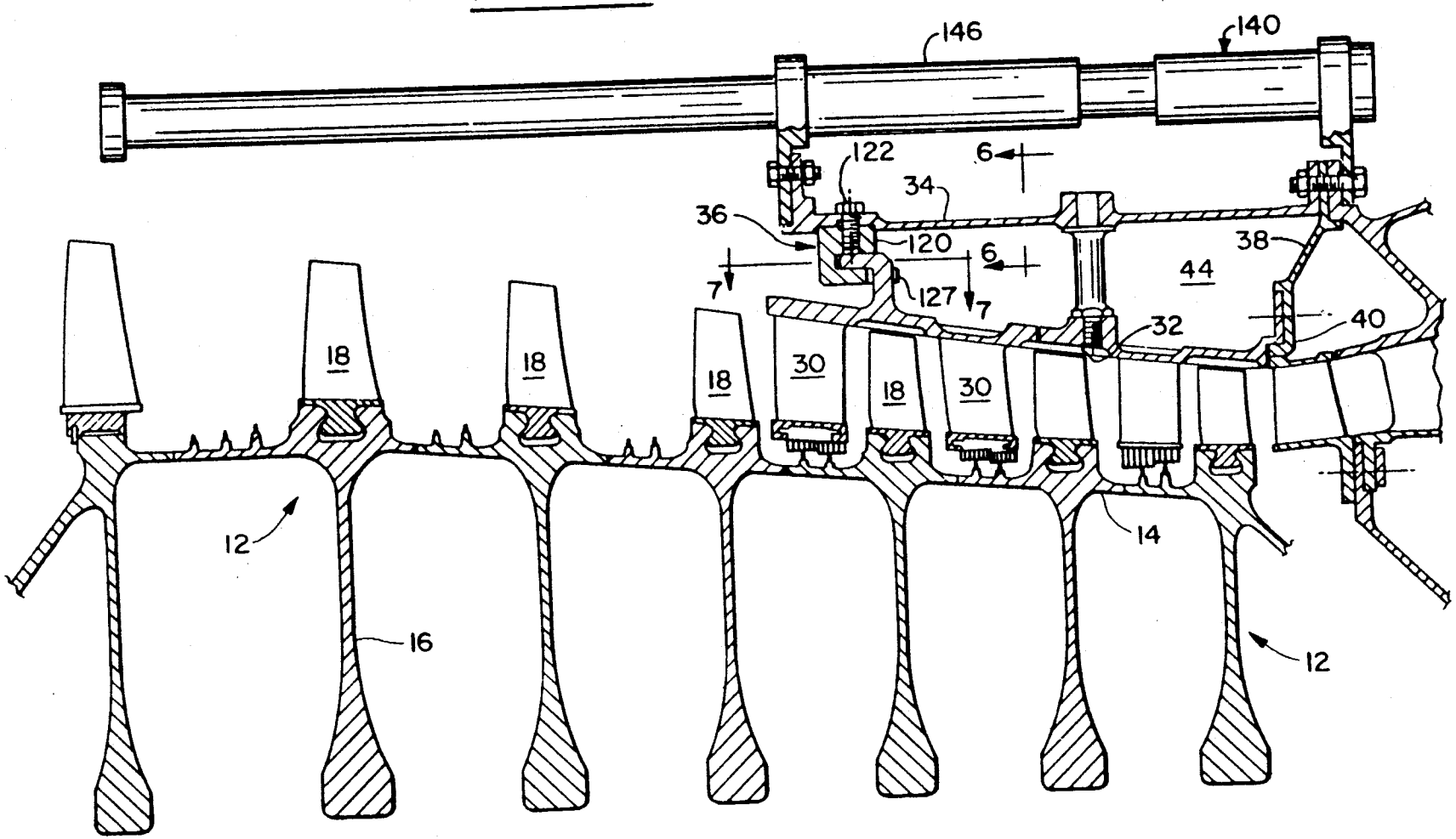
FIG. 5B is another view identical to FIG. 5 and FIG. 5A showing the attachment of the outer case to the stator vanes in the final sequence.
Figure 6:
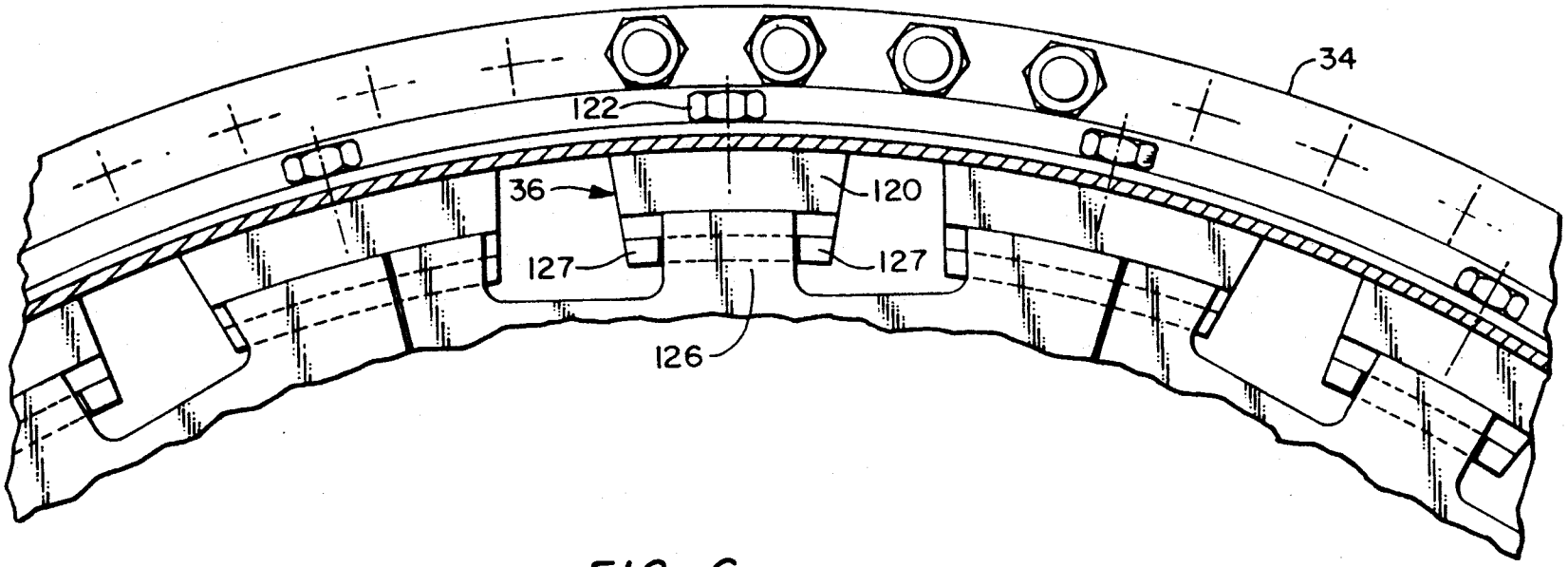
FIG. 6 is a partial end view in elevation taken along lines 6—6 of FIG. 5B.
Figure 7:
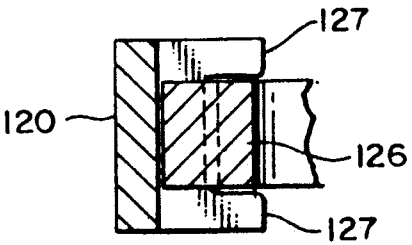
FIG. 7 is a partial view in section taken along lines 7—7 of FIG. 5B.

To prevent the stators from rotating about the engine axis, a plurality of lugs 126 are carried at the end of a portion of the segments 120 and sandwich the hook. This can best be seen by referring to FIG. 6 which is a sectional view taken along lines 6—6 of FIG. 5B.

The support segment 120 is made removable so that the full hoop case 34 can be assembled or disassembled by sliding over the drum rotor/stator vane assembly. The method of assembly and disassembly is depicted by FIGS. 5, 5A and 5B.

Figure 5:
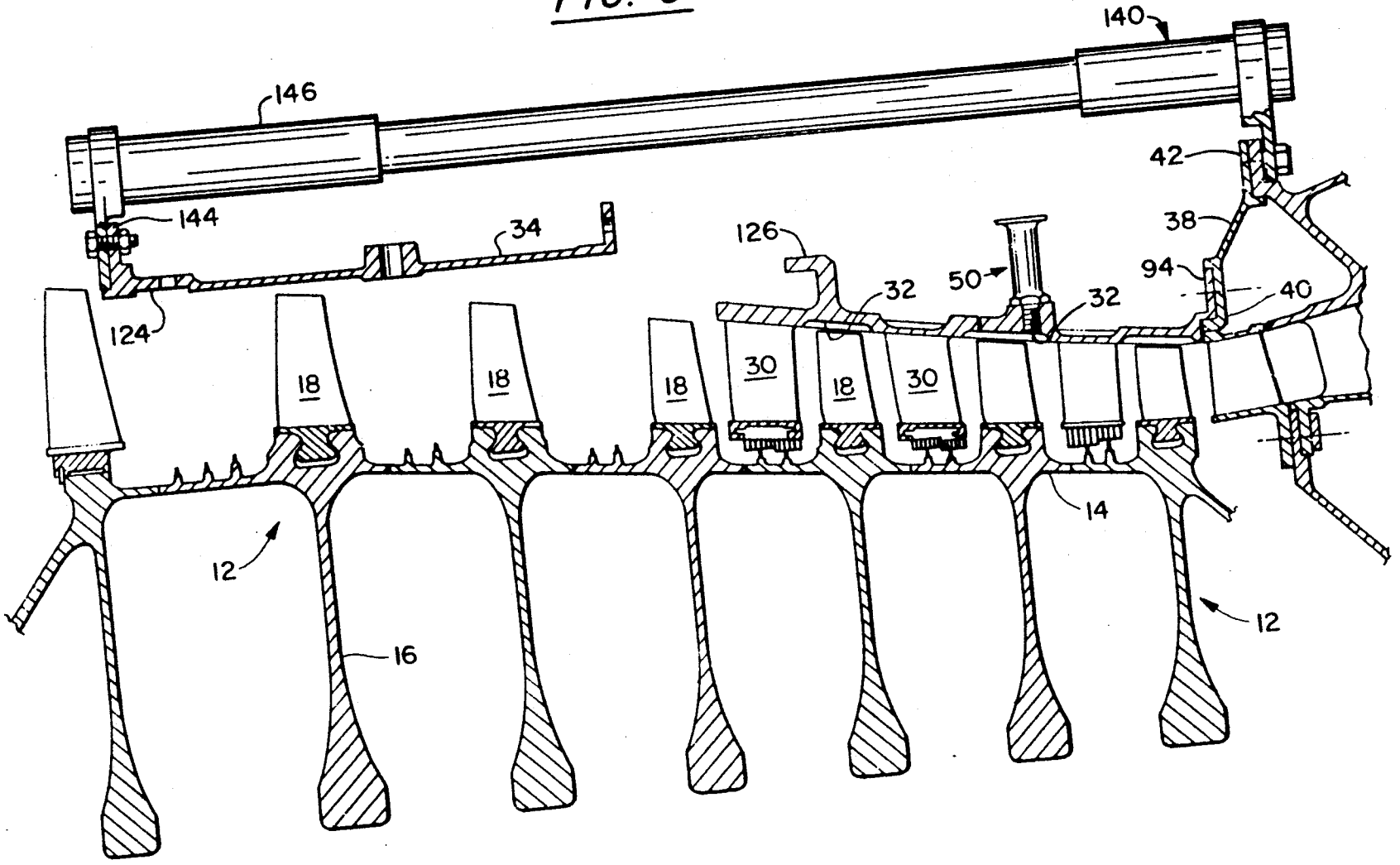
FIG. 5 is a partial view partly in section and partly in elevation showing the method of assembly of a portion of compressor section.
Figure 5A:
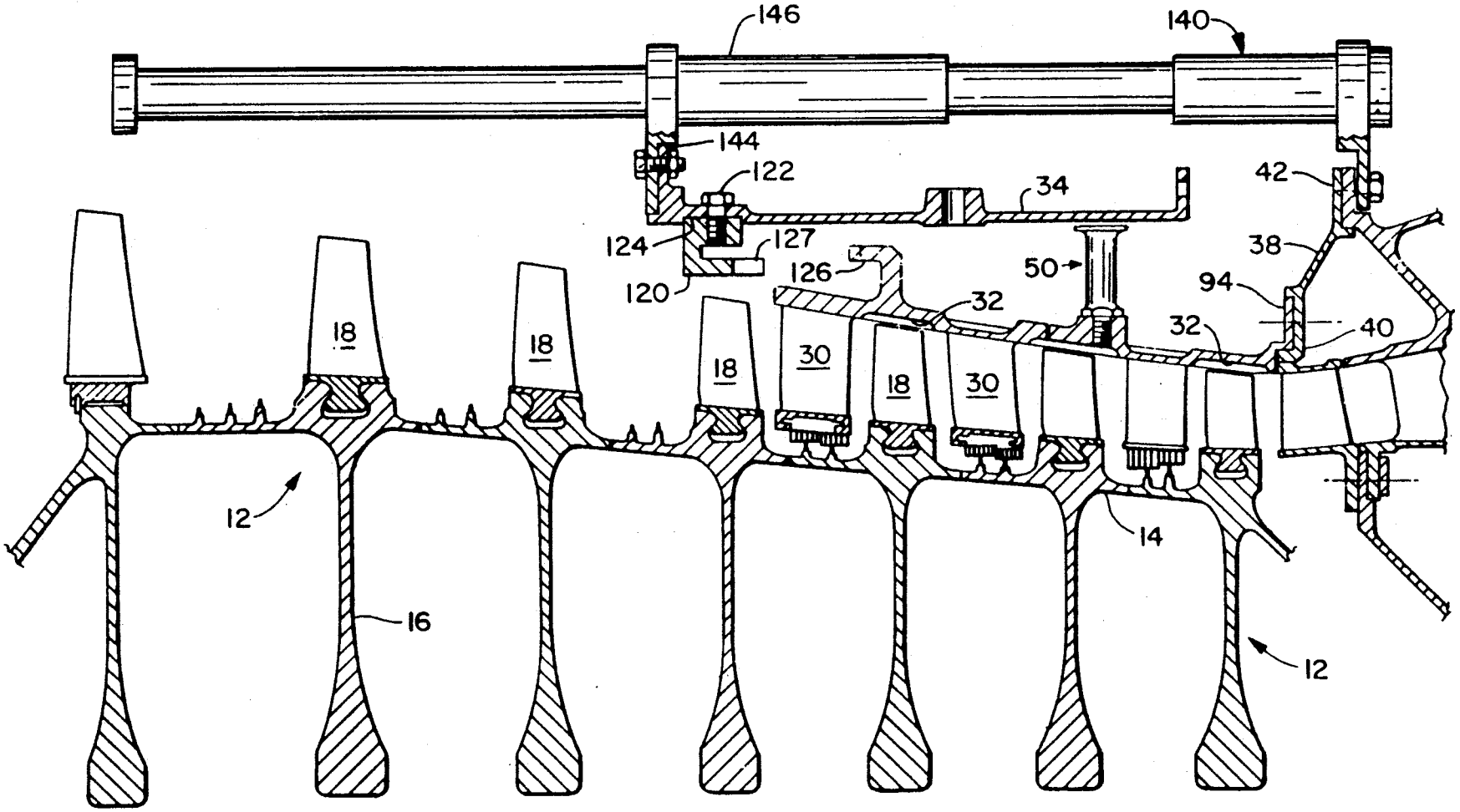
FIG. 5A is a view identical to FIG. 5 showing the assembly in another sequence.

As can best be seen by FIG. 5, the full hoop case 34 is retained by one or more mounting fixture 140 (one being shown) which is fixed on one end to the engine's flange 42. The fore flange 144 is affixed to the complimentary flange extending from the sliding tube 146. At an intermediate axial position the support is bolted to the case 34 as shown in FIG. 5A. The case 34 is then moved axially to align the aft flanges and the spool/nut 62 (see FIG. 5B), whereupon, the fixture 140 is removed and the bolts are tightened to the requisite torque level. The removal of the case, obviously, undergoes the reverse procedures.

It is apparent from the foregoing that the inner case of the stator is suspended and supported to the full hoop outer case and the stator is supported in such a way that permits axial movement and circumferential thermal growth while radially constraining the stator.

Although the invention has been shown and described with respect to detailed embodiments thereof, it will be understood by those skilled in the art that various changes in form and detail thereof may be made without departing from the spirit and scope of the claimed invention.

I claim:

1. For a gas turbine engine having a multistage axial flow compressor including a plurality of compressor blades, a drum rotor supporting said compressor blades and a stator including a plurality of axially spaced rows of stator vanes supported in a axially split compressor case, the improvement comprising a full hoop case supporting the aft stages of said multistage axial flow compressor being secured to the aft end of said axially split compressor case, means for suspending a portion of said segmented inner case from said full hoop outer case, said means including a pair of support elements extending radially at each end of said segmented case and being axially and circumferentially slidably supported to said full hoop outer case, circumferentially spaced bolt means disposed centrally in said full hoop outer case supporting said segmented inner case intermediate the ends thereof, whereby said portion of said segmented inner case is allowed to displace axially and thermally grow circumferentially relative to said full hoop outer case while being constrained radially.

2. For a gas turbine engine as claimed in claim 1 wherein said multistage axial flow compressor includes a backbone, and one of said support elements is attached to said backbone.

3. For a gas turbine engine as claimed in claim 2 wherein said full hoop case includes a pair of flanges extending radially at each end thereof, one of said flanges being attached to said backbone and the other of said flanges being attached to the aft end of said axially split compressor case.

4. For a gas turbine engine as claimed in claim 1 wherein said portion of said segmented inner case includes an axially extending outer shroud and at least a portion of three rows of a portion of said stator vanes are unitarily attached to each segment of said outer shroud whereby said segments of said outer shroud when mounted end-to-end define a complete ring.

* * * * *